United States Patent [19]

Sauer

[11] Patent Number: 4,543,550

[45] Date of Patent: Sep. 24, 1985

[54] ARMATURE MOUNTING FOR AN ELECTROMAGNETIC RELAY

[75] Inventor: Hans Sauer, Fichtenstrasse 5, D-8024 Deisenhofen, Fed. Rep. of Germany

[73] Assignees: Matsushita Electric Works, Ltd., Japan; Hans Sauer, Fed. Rep. of Germany

[21] Appl. No.: 574,822

[22] Filed: Jan. 30, 1984

[30] Foreign Application Priority Data

Feb. 3, 1983 [DE] Fed. Rep. of Germany ..... 3303666

[51] Int. Cl.[4] ..... H01H 51/22

[52] U.S. Cl. ..... 335/78; 335/81; 335/270

[58] Field of Search ..... 335/78, 79, 80, 81, 335/229, 230, 270, 276

[56] References Cited

U.S. PATENT DOCUMENTS

| | | | |
|---|---|---|---|
| 3,946,347 | 3/1976 | Sauer | 335/78 X |
| 3,987,383 | 10/1976 | Antonitsch | 335/78 |
| 3,993,971 | 11/1976 | Ono et al. | 335/78 X |
| 4,225,835 | 9/1980 | Vrsnak et al. | 335/81 X |
| 4,296,393 | 10/1981 | Sauer et al. | 335/125 |
| 4,323,945 | 4/1982 | Sauer | 335/78 X |

*Primary Examiner*—George Harris

*Attorney, Agent, or Firm*—Schwartz, Jeffery, Schwaab, Mack, Blumenthal & Evans

[57] ABSTRACT

An electromagnetic relay includes an armature 1 supported in a central longitudinal bore 12 of a one-part bobbin 2 by means of a bearing which includes a first pair of curved bearing surfaces 1*a*, 1*b*, formed on the armature 1 and engaging a second pair of supplementarily curved bearing surfaces 2*a*, 2*b*, formed in the bore walls. The first bearing surfaces 1*a*, 1*b* may be either cylindrical in which case cylindrical second bearing surfaces 2*a*, 2*b* are formed in ribs 2*c*, 2*d* projecting inwardly from opposite bore walls, or spherical in which case spherical second bearing surfaces are formed directly in opposite bobbin walls.

11 Claims, 12 Drawing Figures

ARMATURE MOUNTING FOR AN ELECTROMAGNETIC RELAY

DESCRIPTION

This invention relates to an electromagnetic relay, more specifically to an electromagnetic relay of the type in which the coil bobbin has a longitudinal central bore in which an armature is mounted for pivotal movement about a transverse axis.

A relay of this type is known from U.S. Pat. No. 3,987,383 to S. Antonitsch. Due to the disposition of the armature within the coil, this known relay has an excellent efficiency. Also, since the armature is supported for rotation about one of its axes of gravity, the relay is highly insensitive to shocks and vibration. In order to receive and pivotally support the armature, however, the bobbin is formed of two parts, with the result that the withstand voltage between the relay coil and the armature and between the coil and the contacts, which are also disposed within the bobbin, is limited.

German Patent Specification No. 2 461 884 discloses another prior-art relay which has a one-part coil bobbin formed as a protective tube and an armature disposed in the bobbin. The armature is current-carrying and acts as a bridge contact cooperating with two fixed contacts provided on two flanges of the coil bobbin. For switching, it pivots about its center where it is supported by a cylindrical stud which rests in the protective tube with a play for compensating tolerances. With this type of bearing, an intentional contact closure between the armature and the respective opposite fixed contact is prevented. Also, the bearing is easy to manufacture. The armature, however, is displacable along its longitudinal direction, with the result that the relay is less suited for applications in which shocks or vibrations occur or which require an accurate response characteristic.

It is an object of the present invention to provide a relay in which the armature is supported within a one-part coil bobbin, the bearing for the armature being so formed that both ends of the armature may abut against pole, contact or actuating pieces with equal forces, at the same time preventing longitudinal displacement of the armature relatively to the bobbin.

In view of this object, the electromagnetic relay of the present invention comprises a bobbin carrying a coil and having a central bore extending along a longitudinal axis of the bobbin; an armature disposed in said bore; and a contact system operated by said armature; said armature having a pair of first curved bearing surfaces and said bobbin bore providing a pair of second curved bearing surfaces disposed opposite each other and cooperating with said first bearing surfaces to support said armature for pivotal movement about a transverse axis. The bearing surfaces may be either cylindrical, in which case the second bearing surfaces are formed in ribs projecting inwardly from opposite walls defining the bobbin bore, or they may be spherical, in which case the second bearing surfaces are formed directly in such opposite walls.

A one-part coil bobbin may thus be produced at little expense with an integrally formed bearing which is reproduceable with close tolerances and ensures the desired uniform abutment of the armature ends at the respective opposite pole pieces or fixed contacts. The second bearing surfaces may be shaped as recesses in opposite walls of the bobbin and are produced, for instance, during the molding of the bobbin by means of a correspondingly shaped insert or die. The depth of the recessed cylindrical or spherical second bearing surfaces is so selected that the elasticity of the material forming the walls of the coil bobbin allows the insert or die to be removed without difficulty upon completion of the bobbin molding step.

Further objects and advantages of the invention would become apparent from the following description of preferred embodiments which is made with reference to the drawings, in which FIG. 1 is a longitudinal section taken along the line C-D of FIG. 2, showing a relay bobbin with a coil and an armature inserted in a central bore of the bobbin;

Figure 1:
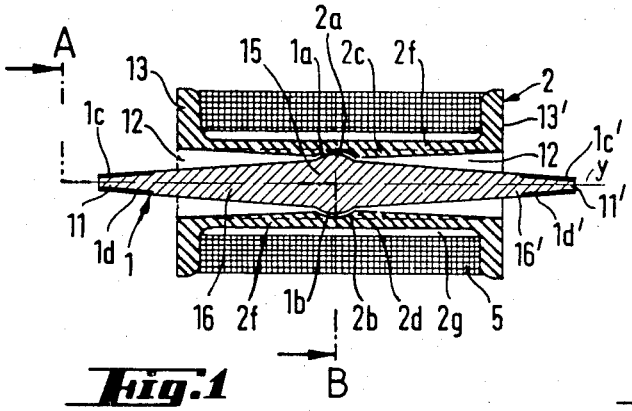

As shown in FIG. 1, an armature 1 is supported in a coil bobbin 2 made of plastics material. The armature 1 is formed with convex bearing projections 1*a* and 1*b* projecting from the armature and engaging corresponding bearing recesses 2*a* and 2*b* formed in the bobbin 2. The armature 1 is provided with contact surfaces 1*c*, 1*d* and 1*c*', 1*d*' at its free ends 11 and 11' and is supported for pivotal movement about an axis x (FIG. 2) in such a manner that the contact surfaces are enabled to cooperate with fixed contacts not shown in FIG. 1. The bobbin 2 has a rectangular cross-section and a central bore 12 extending throughout the bobbin 2 from one end face 13 to the opposite end face 13'. The armature 1 is inserted in this bore 12.

Figure 2:
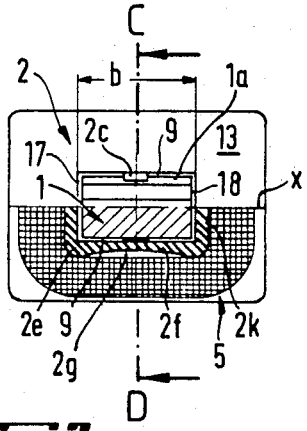
FIG. 2 is a cross-section taken along the line A-B of FIG. 1.

While the cross-section of the armature is shown in all embodiments as rectangular, this is not a necessary feature of the invention. As indicated in FIG. 2, the armature has upper and lower surfaces 9 and left and right side surfaces 17, 18. The bobbin 2 includes upper and lower walls 2*f* and left and right side walls 2*e* and 2*k*. The ends of these bobbin walls are formed as bobbin flanges defining the end faces 13 and 13'.

A pair of ribs 2*c*, 2*d* projects from the upper and lower walls 2*f* of the bobbin into the bore 12. As shown in FIG. 2 for the upper rib 2*c*, these ribs are narrow as compared to the overall width of the bore. The bearing recesses 2*a* and 2*b* are formed in these upper and lower ribs 2*c* and 2*d*.

The outer surfaces of the upper and lower bobbin walls 2*f* are provided with curved cavities 2*g*, the thickness of the wall decreasing towards the central region where the ribs 2*c* and 2*d* are formed, as indicated in FIG. 2 at the lower bobbin wall. These cavities 2*g* achieve a certain elasticity of the walls 2f even in case the bobbin is made of a relatively hard-elastic plastics material. This elasticity is required for inserting the armature 1 into the bore 12 for snap-in engagement of the bearing projections 1a, 1b in the bearing recesses 2a, 2b. For further facilitating this inserting step, the height of the ribs 2c and 2d is not uniform along the length of the bore 12 but decreases from the center thereof towards the end faces 13, 13'. The ribs 2c, 2d may be formed so that they disappear before reaching the ends of the bore 12.

The two arms 16, 16' of the armature 1 extending from the central portion 15 thereof similarly have a thickness which continually reduces towards the ends. The central portion 15 has the curved bearing projections 1a and 1b which, in the present embodiment, extend over the entire width b of the armature 1 from the left sidewall 17 to the right sidewall 18. These bearing projections 1a, 1b are cylindrical with respect to the axis x, and they may be manufactured easily with sufficient strength to avoid any danger of breaking, as may occur with bearing studs.

With the part-cylindrical formation of the bearing projections 1a, 1b shown in the embodiment of FIGS. 1 and 2, the cylinder axis coincides with the pivot axis x. The bearing recesses 2a, 2b in the bobbin walls 2f are formed with a complementary part-cylindrical curvature by means of a corresponding die or insert. In this connection, when the die or insert is removed from the bore 12 upon completion of the molding step, a similar snap-action due to the elasticity of the walls 2f occurs as during the inserting of the armature 1.

The armature bearing formed by the opposing projections 1a, 1b on the armature 1 and the corresponding recesses 2a, 2b inside the bobbin 2, as shown in FIGS. 1 and 2, is made with loose tolerances to provide the armature with at least two limited degrees of freedom. One of these degrees of freedom exists in the direction of rotation about the pivot axis x and the other exists in the direction of tilting about an axis y (FIG. 1) which extends transversely of the pivot axis x.

Both the curved bearing projections 1a, 1b and the bearing recesses 2a, 2b are integrally formed and may thus be produced with high precision. In order to allow the die or insert used for creating the recesses 2a, 2b to be removed from the mold of the bobbin 2 without destruction, the walls 2f are required to yield resiliently. For this reason, the ribs 2c, 2d are not only relatively narrow but also disposed centrally where the resiliency is the greatest. In addition, the centrally disposed ribs 2c, 2d achieve the limited degree of freedom by permitting the armature 1 to rock around the y axis to compensate tolerances during contact closure between the armature ends 11, 11' with the fixed contacts not shown in FIG. 1.

Since the relay coil 5 is coiled with varying mechanical tension and since temperature variations occur, care must be taken that the varying pressure thus produced is not transferred to the bearing formed by the projections 1a, 1b and recesses 2a, 2b. To this end, the upper and lower walls 2f of the bobbin 2 in which the recesses 2a, 2b are formed, have their outer surfaces provided with the cavities 2g so that they are clear of the coil 5.

Figure 3:
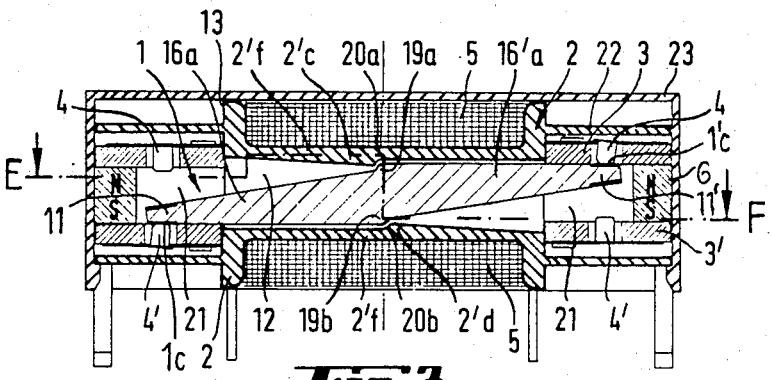
FIG. 3 is a longitudinal section along the line G-H of FIG. 4, showing a relay according to another embodiment of the invention.
Figure 4:
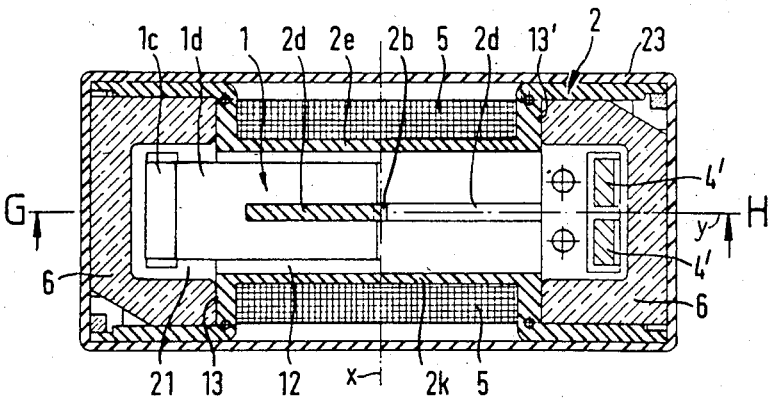
FIG. 4 is a section taken along the line E-F of FIG. 3.

FIGS. 3 and 4 show another embodiment of the relay according to the present invention which is designed with central symmetry, and identical references apply for symmetrically disposed parts. The embodiment of FIGS. 3 and 4 is a bistable polarized relay including at least one permanent magnet 6 which preferably consists of an electrically insulating ferrite adapted to be activated as a getter and pole pieces 3, 3' abutting the magnet 6. Resiliently mounted on the pole pieces are counter-contacts 4 and 4' of a material resistent against consumption by burning, such as tungsten or silver-cadmium oxide, which serve as leading and lagging contacts during switching, and a main contact of noble metal such as a silver layer (not shown) electroplated directly on the pole pieces 3, 3' for substantially voltage-free switching and for carrying the load current which flows from one end of the armature to the other. A more detailed explanation of the operation of these contacts is disclosed in U.S. Pat. Nos. 4,296,393 and 4,323,945. As also described in those references, the contact areas of the armature ends engage the respective opposing fixed contacts at least along lines, such line contact being achieved by the tolerance-compensating play of the armature bearing. As a matter of course, the bearing play must not be excessive to avoid an otherwise occurring undue variation of the relay response characteristic. The thus disclosed armature takes the function of a bridge contact with double interruption of the load circuit.

As shown in FIG. 3, the armature 1 has two arms 16a, 16'a which appear to be interconnected not symmetrically but in a manner slightly displaced transversely of the armature longitudinal axis. Due to this displacement, shoulders 19a, 19b forming bearing surfaces are created at the upper and lower sides of the armature 1. Opposite the bearing shoulders 19a, 19b, complementarily formed counter bearing shoulders 20a, 20b are formed in ribs 2'c, 2'd. Similar to the ribs 2c, 2d in FIG. 1, the ribs 2'c, 2'd project with decreasing height from the center region of the bobbin 2 towards the end faces 13, 13' thereof. However, according to the central-symmetrical formation of FIG. 3, the ribs 2'c, 2'd are each formed only in the respective half of the bobbin bore 12. In the representation of FIG. 3, the rib 2'd exists only in the right half of the bore 12, so that the left armature arm 16a' due to the above-mentioned displacement has its lower surface in the position shown in FIG. 3 extending parallel to the axis of the bore 12 from the bearing shoulder 19b to the free end 11 where the contact surface 1c engages the resilient counter-contact 4'. Similarly, the rib 2'c at the upper wall 2'f of the bore 12 exists only in the left half and forms the counter bearing shoulder 20a cooperating with the bearing shoulder 19a of the armature from which, in the position shown in FIG. 3, the upper surface of the right armature arm 16'a extends parallel to the longitudinal axis of the bore 12 to the armature end 11' where the contact surface 1'c cooperates with the resilient counter-contact 4.

In the embodiments of FIGS. 3 and 4, the bearing shoulders 19a and 19b are part-cylindrical with the axis of the cylinder coinciding with the pivot axis x. The same applies to the correspondingly shaped counter bearing shoulders 20a and 20b formed by the ribs 2'c and 2'd. The length of the cylinder segment is sufficient to ensure that the armature, even when in a middle position between two contacts during switching-over, is not lifted off the counter bearing shoulders by shocks, but is safely supported there. During assembly, the projecting bearing shoulders of the armature 1 will snap into the counter bearing shoulders.

In the embodiments of FIGS. 3 and 4, the armature arms 16a, 16'a extend from the end faces 13, 13' of the bobbin 2 into contact chambers 21 each of which is confined by a pair of opposite pole pieces 3, 3' and a permanent magnet 6. In the pole pieces 3, 3', the counter-contacts 4, 4' are so disposed side-by-side that they are opposite to the respective contact surface 1*c*, 1*d* of the armature 1. The contact chambers 21 terminate the bore 12 of the bobbin 2, and this entire space may be filled with a protective gas.

Supporting walls 22 extend outwardly from the end faces 13, 13' of the bobbin, which serve not only to protect the pole pieces 3, 3', the contacts 4, 4' and the permanent magnet 6 but also to support a relay casing 23 at the ends thereof, the upper part of the casing 23 being supported by the flanges of the bobbin 2. In the embodiment of FIGS. 3 and 4, the walls 22 are integrally formed with the bobbin 2.

The bobbin 2 with its half ribs 2'*c*, 2'*d* extending from opposite bobbin walls and to opposite ends of the bobbin, as shown in FIG. 3, is particularly easy to mold by means of two inserts introduced into the bore from opposite ends and removed upon completion of the molding step without requiring any elastic deformation of the bobbin. This permits the use of duroplastic material for the bobbin, thus the application of the relay at higher loads and temperatures.

Figure 5:
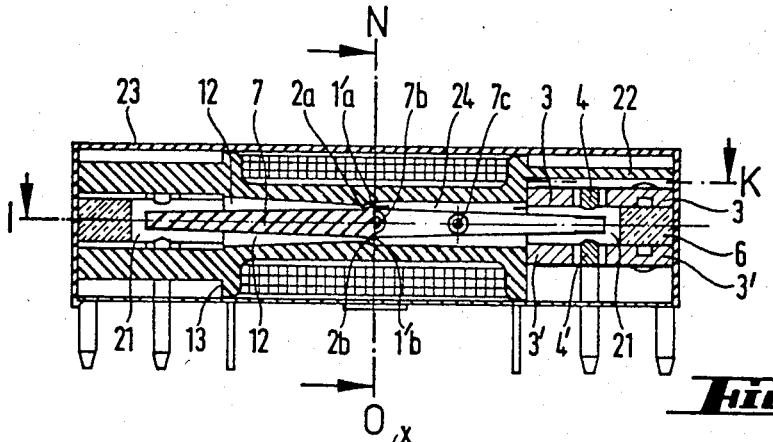
FIG. 5 is a section along the line L-M in FIG. 6, showing a further embodiment of the invention having a double armature arrangement.
Figure 6:
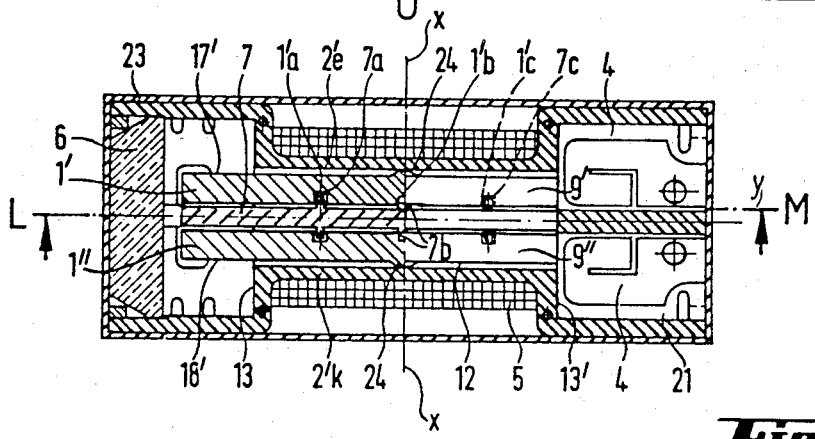
FIG. 6 is a section along the line I-K of FIG. 5.
Figure 7:
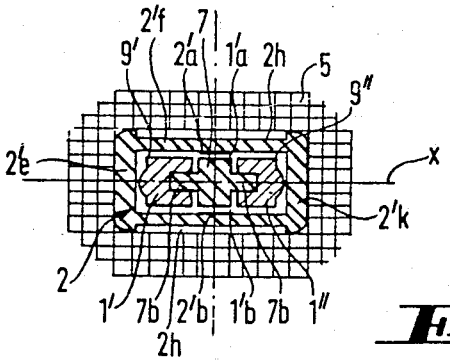
FIG. 7 is a section along the line N-O of FIG. 5.

The further embodiment of the invention shown in FIGS. 5 to 7 relates to a relay having two circuits and two armatures 1', 1''. To achieve synchronous operation, the two armatures 1', 1'' are mounted on a common bearing member 7 of insulating material, with the bearing being formed similar to the previous embodiments. Pins 7*a* to 7*c* are formed at the bearing member 7 and engage corresponding holes 1'*a*, 1'*b* and 1'*c* in both armatures 1', 1''. It is required in this embodiment that an essentially greater play exists between the holes 1'*a*, 1'*c* and the pins 7*a*, 7*c* then between the hole 1'*b* and the bearing pin 7*b* proper. While two such connections are substantially sufficient, three connections increase the mechanical strength.

As shown in FIG. 6, the two armatures 1', 1'' have their outer shape formed similar to that of the bearing member 7 so that the assembled two armatures and bearing member appear like a homogeneous armature. Bearing surfaces 24 are formed on the outer sides 17' of the armature 1' and 18' of the armature 1'' which bearing surfaces 24 cooperate with the inner surfaces of the bobbin walls 2'*e* and 2'*k* to maintain the armatures 1', 1'' and the bearing member 7 in their assembled condition. Such lateral tilting bearing surfaces are particularly useful with combined armatures. In another embodiment not shown, the surfaces of the bobbin sidewalls may be provided with recesses cooperating with the tilting bearing surfaces 24 and forming a snap-in engagement therewith similar to the pivot bearing projections and recesses 1'*a*, 1'*b*, 2*a*, 2*b*.

Referring to FIG. 7, cavities 2*h* are formed in the outer surfaces of the upper and lower walls 2'*f* of the coil bobbin 2 carrying the coil 5 to increase the elasticity and prevent pressure from the coil to act on the bearing. In the embodiment of FIG. 7, these cavities have a rectangular cross-section.

Figure 8:
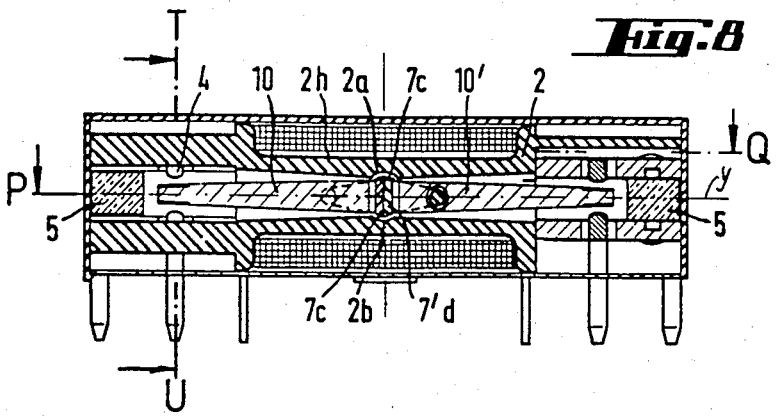
FIG. 8 is a section along the line R-S of FIG. 9, showing another embodiment of the invention having a separate bearing member.
Figure 9:
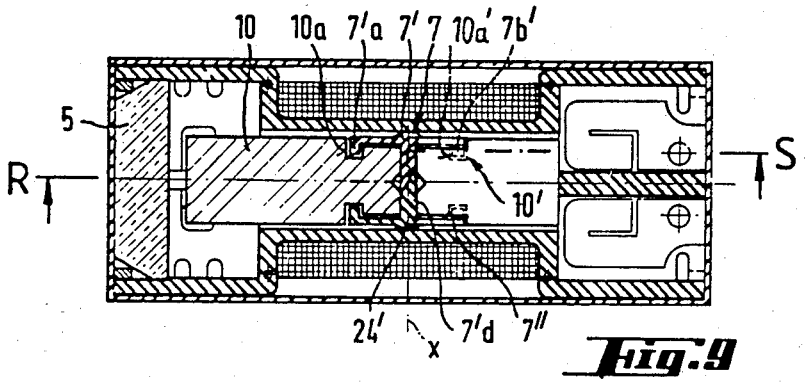
FIG. 9 is a section taken along the line P-Q in FIG. 8.
Figure 10:
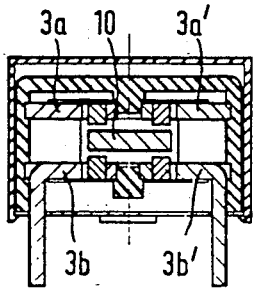
FIG. 10 is a section along the line T-U in FIG. 8.
Figure 11:
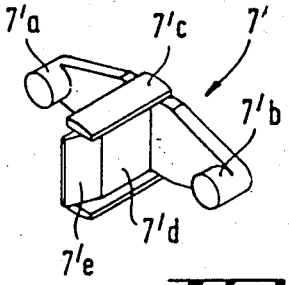
FIG. 11 is a perspective view of one-half of the bearing member.

The embodiment of FIGS. 8 to 11 relates to a relay which is also capable of completing two circuits in either switching position. As shown in FIG. 9, either one of two armatures 10, 10' is laterally connected with a bearing member 7 (see FIG. 11) which is made of two parts 7', 7'', by means of pins 7'*a*, 7'*b* formed integrally with the bearing member parts and engaging in corresponding holes 10*a*, 10*a'* with tolerance-compensating play. The bearing member part 7' has two opposite curved surfaces 7'*c* which act as bearing projections and are interconnected by a web 7'*d* to support both armatures 10, 10' in bearing recesses 2*a* formed in the bore of the bobbin 2 as shown in FIG. 8.

The play between the pins 7'*a*, 7'*b* and the corresponding holes 10*a*, 10*a'* in the two armatures 10, 10' provides limited degrees of freedom for compensating tolerances between the two armatures and between the armatures and the fixed contacts formed by the pole pieces 3*a*, 3*a'*, 3*b*, 3*b'*. A largely synchronous contact actuation in both circuits and balanced contact forces at the ends of both armatures are thus achieved.

This type of bridge contact is advantageous over that previously described in that the contact bridge extends perpendicularly to the magnetic fluxes thereby obtaining a magnetic blowing effect on any arc occurring during switching.

Since it is necessary with current-carrying parts to take care of creeping and leakage distances, the bearing member parts 7', 7'' are assembled along two intermediate oblique surfaces 7'*e* (FIG. 11) so that the overall armature is formed of four parts, namely the left armature 10, the right armature 10', and the two bearing member parts 7', 7'' which, by means of the pins 7'*a*, 7'*b* hold the armatures together like brackets.

The curved surfaces 7'*c* providing the bearing projections are formed on both bearing member parts 7', 7''. Moreover, both bearing member parts 7', 7'' may be provided with bearing surfaces 24' similar to the embodiment of FIG. 6, thereby achieving a support against tilting in addition to a strong bracketing of the two armatures 10, 10' due to the pressure acting on the bearing surfaces 24' by the lateral walls of the bobbin bore, which pressure may be reduced down to zero in accordance with the respective design and also dependent on the coil.

The parts 7', 7'' of the bearing member 7 may be made of a material different from that of the armatures 10, 10', so that the overall armature is very easy to manufacture and practically all functional requirements are fulfilled by the bearing member 7.

Figure 12:
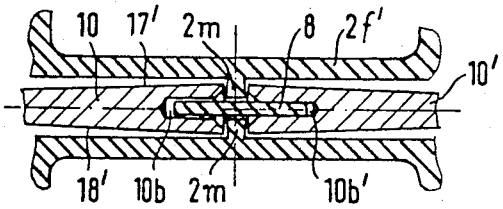
FIG. 12 is a partial section through a further embodiment of the invention having another bearing structure.

A further embodiment is shown in FIG. 12 where a bearing shaft 8 of insulating material is provided which extends through a web 2*m* in the bobbin and into holes 10*b*, 10*b'* of two armatures 10, 10'. The two armatures 10, 10' are thus separated by the web 2*m* but attract each other magnetically so that they are positioned by magnetic forces in one direction. The pivotal rotation is limited by the smallest distance between the armatures 10, 10' and the bobbin walls 2*f*. As indicated in FIG. 12, the shaft 8 may be press fitted into the armature 10' and loosely fitted into the other armature 10.

I claim:

1. An electromagnetic relay comprising:

a one-part bobbin carrying a coil and having a central bore extending along a longitudinal axis of the bobbin, and including a pair of opposite, elastic walls, with a pair of ribs projecting from said elastic walls towards each other, armature means disposed in said bore, and a contact system operated by said armature means, said armature means having a pair of first curved bearing surfaces, and said ribs providing a pair of second curved bearing surfaces cooperating with said first bearing surfaces to support said armature means for pivotal movement about a transverse axis, said elastic walls allowing said armature means to be inserted in said bore with loose-play snap-engagement between said first and second pairs of bearing surfaces.

2. The relay of claim 1, wherein said armature has third lateral bearing surfaces cooperating with fourth bearing surfaces provided by opposite sidewalls of said bobbin.

3. The relay of claim 1, wherein the center of said first and second curved bearing surfaces lies on said transverse axis.

4. The relay of claim 1, wherein said first and second bearing surfaces are formed as bearing shoulders formed opposite to each other so as to prevent displacement of said armature means in said bore in either direction along said longitudinal axis.

5. The relay of claim 1, further comprising a bearing member connected to said armature means and providing said pair of first bearing surfaces.

6. The relay of claim 5, wherein said armature means and bearing member are each made of two parts, each bearing member part having means for holding with play a corresponding one of the parts of said armature means.

7. The relay of claim 5, wherein said armature means is made of two parts disposed on opposite sides of the bearing member.

8. The relay of claim 1, wherein said ribs extend in the longitudinal direction of said bobbin bore in the plane defined by the pivotal movement of said armature.

9. The relay of claim 8, wherein the ribs are formed with a height decreasing from the center of the bobbin towards the ends thereof.

10. The relay of claim 1, wherein said bobbin has concave portions formed in the outer surfaces of the bobbin walls carrying said coil.

11. The relay of claim 1, wherein said armature means includes two parts and said first pair of bearing surfaces is formed on a bearing member disposed between the inner ends of said parts of said armature parts.

* * * * *